US005961304A

United States Patent [19]

Parenti et al.

[11] Patent Number: 5,961,304

[45] Date of Patent: Oct. 5, 1999

[54] INJECTION PUMP FOR DIESEL-CYCLE INTERNAL COMBUSTION ENGINES

[75] Inventors: Gino Parenti; Umberto Verza, both of Reggio Emilia, Italy

[73] Assignee: Lombardini Fabbrica Italiana Motori S.p.A., Reggio Emilia, Italy

[21] Appl. No.: 09/084,131

[22] Filed: May 26, 1998

[30] Foreign Application Priority Data

Jun. 10, 1997 [IT] Italy ..... RE97A0040

[51] Int. Cl.[6] ..... F02M 59/26; F02M 45/06

[52] U.S. Cl. ..... 417/500; 123/467

[58] Field of Search ..... 123/449, 451, 123/467, 503; 417/289, 499, 500

[56] References Cited

U.S. PATENT DOCUMENTS

| | | | |
|---|---|---|---|
| 3,648,673 | 3/1972 | Knape | 123/467 X |
| 3,930,480 | 1/1976 | Yamada et al. | 417/499 |
| 4,711,221 | 12/1987 | Laufer | 123/467 X |

FOREIGN PATENT DOCUMENTS 1037219 9/1953 France .

WO8805498 7/1988 WIPO .

*Primary Examiner*—Tony M. Argenbright

[57] ABSTRACT

An injection pump for diesel-cycle internal combustion engines includes a casing (1), a cylinder (6) within the casing and communicates, via at least one radial aperture (51), with a fuel intake chamber (3), and a piston (7) sealedly slidable within the cylinder and which, by external command, can also rotate about its axis to assume different angular orientations about a reference plane. In its jacket, a helical groove (72) opens into an axial groove (71), wherein the top, or roof, of the piston (7) is connected via a hole (77) to two channels (178, 179) provided at different levels in the piston jacket. The first (178) is in an intermediate position between the top of the piston and highest part of the groove (72) and during the reciprocating movement of the piston (7) faces a first radial aperture (52) provided in the cylinder and communicates with the fuel intake chamber (3), the second (179) is at a distance from the top of the piston such that, when in the top dead center position, it mates with a radial aperture (53) provided in the cylinder and communicates with the fuel intake chamber (3).

2 Claims, 3 Drawing Sheets

INJECTION PUMP FOR DIESEL-CYCLE INTERNAL COMBUSTION ENGINES

This invention relates to feed systems for diesel-cycle internal combustion engines, and in particular to those systems using direct fuel injection into the cylinder.

This type of engine, which is known and widely used both in the single-cylinder version and in the multi-cylinder version, has the drawback of a not always gradual and optimum fuel combustion.

This drawback manifests itself as substantial exhaust smoke and gas emission, and a typical engine noise known as combustion noise, which is very annoying and so loud as to limit the application of diesel engines because of the high resultant pollution level.

Both the uncontrolled combustion and the considerable noise of said engines derive mainly from the method of injecting the fuel into the combustion chamber.

The object of this patent is to reduce these phenomena by suitable modifications to the method of injection.

For a better understanding of the considerations given hereinafter, some initial explanation will be given.

Fuel is injected into the combustion chamber of direct-injection diesel engines by an appropriate device known as an injection pump, by which the quantity of fuel fed at each combustion cycle is metered on the basis of the performance required of the engine.

Known injection pumps consist of a cylindrical jacket comprising at a certain point of its axial extension a fuel intake hole and sealedly containing a pumping piston driven with reciprocating movement. The piston has a helical groove connected at one end to an axial groove which opens into the roof of the piston.

The reciprocating movement of said piston within said jacket causes the outer surface of the piston, during its outward stroke, to block the fuel intake hole, which is again exposed when said helical groove becomes positioned in correspondence with it.

Depending on the angular position of the piston, which besides moving axially can rotate about its axis, the point of interference with the helical groove of the fuel intake hole varies, and with it there varies the useful stroke of the piston which, depending on its angular position, pumps a greater or lesser quantity of fuel into the engine combustion chamber.

Downstream of the described pumping unit there is positioned a valve, known as the delivery valve, which rises to open by the effect of the pumped fuel pressure, and falls when said pressure falls below the pressure set by the injection setting spring.

Hence in known engines a predetermined fuel quantity is pumped into the cylinder, causing sudden increase in the pressure within the head of the combustion chamber, this being responsible for the aforesaid characteristic combustion noise.

Fuel entry begins with a certain advance (dynamic advance) on the commencement of combustion, the combustion process causing a pressure gradient responsible for the noise, the smoke and the harmful exhaust emissions.

In this respect, because of the fuel compressibility, fuel entry continues even after the useful piston delivery stroke has terminated, also because of the fact that the fuel discharge ports may be insufficient on termination of the piston delivery stroke.

The object of this invention is to obviate the aforesaid drawback by providing a pumping unit, the characteristics of which are defined below.

The merits and the functional and constructional characteristics of the invention will be more apparent from the ensuing detailed description given with reference to the figures of the accompanying drawings, which show a preferred embodiment thereof by way of non-limiting example.

Figure 1:
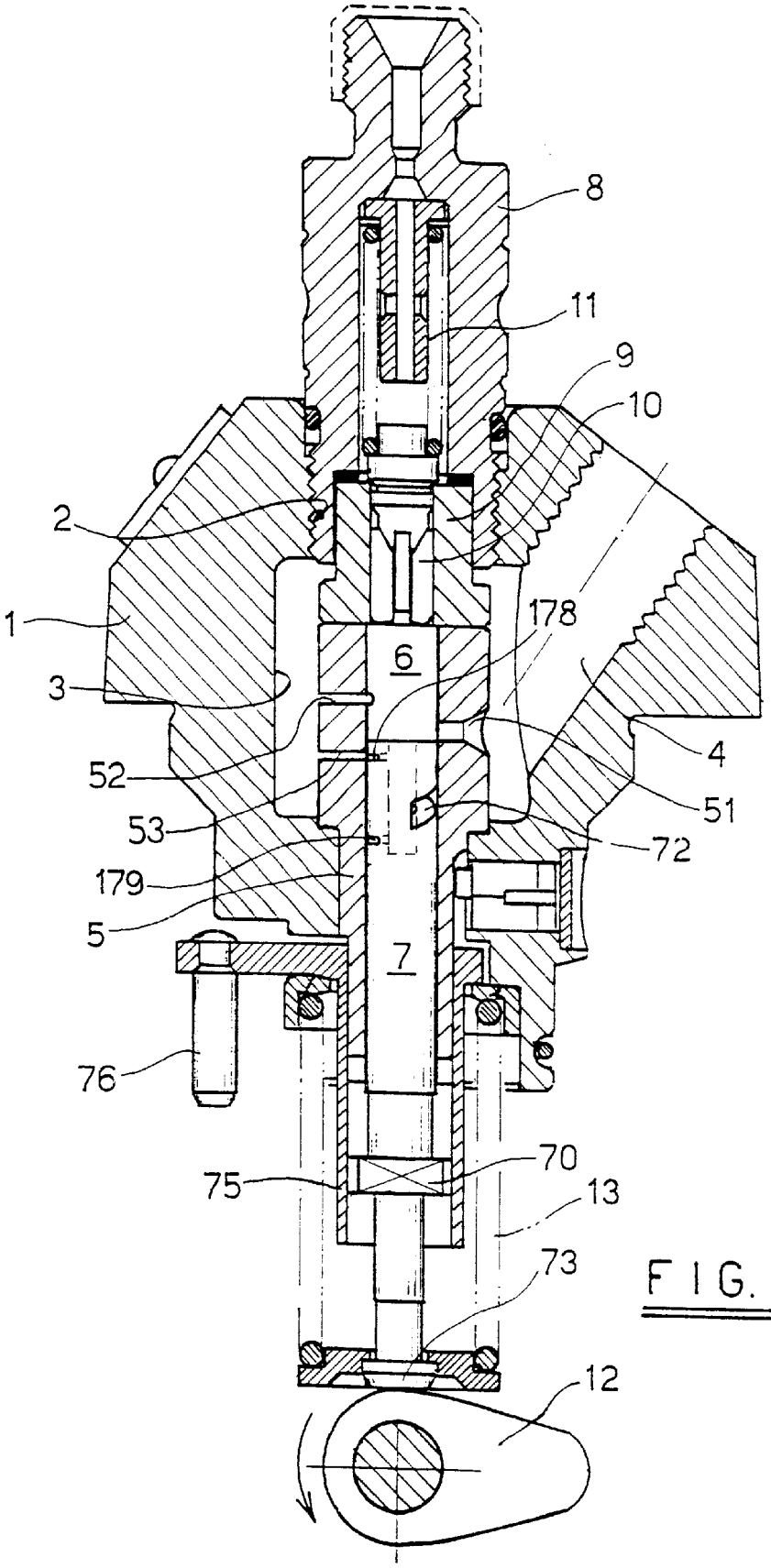
FIG. 1 is an axial section through an injection pump of the invention, with the pumping piston shown schematically.

In terms of the characteristics essential for understanding the invention, said figures show an injection pump comprising an outer casing 1 with a through cylindrical cavity 2 having a widened part 3.

A conduit 4 connects the widened part 3 of the cavity 2 to the outside.

The cavity 2 is occupied by a cylindrical bush (pumping body) 5 of different cross-sections and having an axial cylindrical cavity 6 forming the seat for the pumping piston 7.

Above the bush 5 the cavity 2 is closed by means 8, 9 which contain the delivery valve 10 and the atomizer 11.

Figures 2, 3, 4:
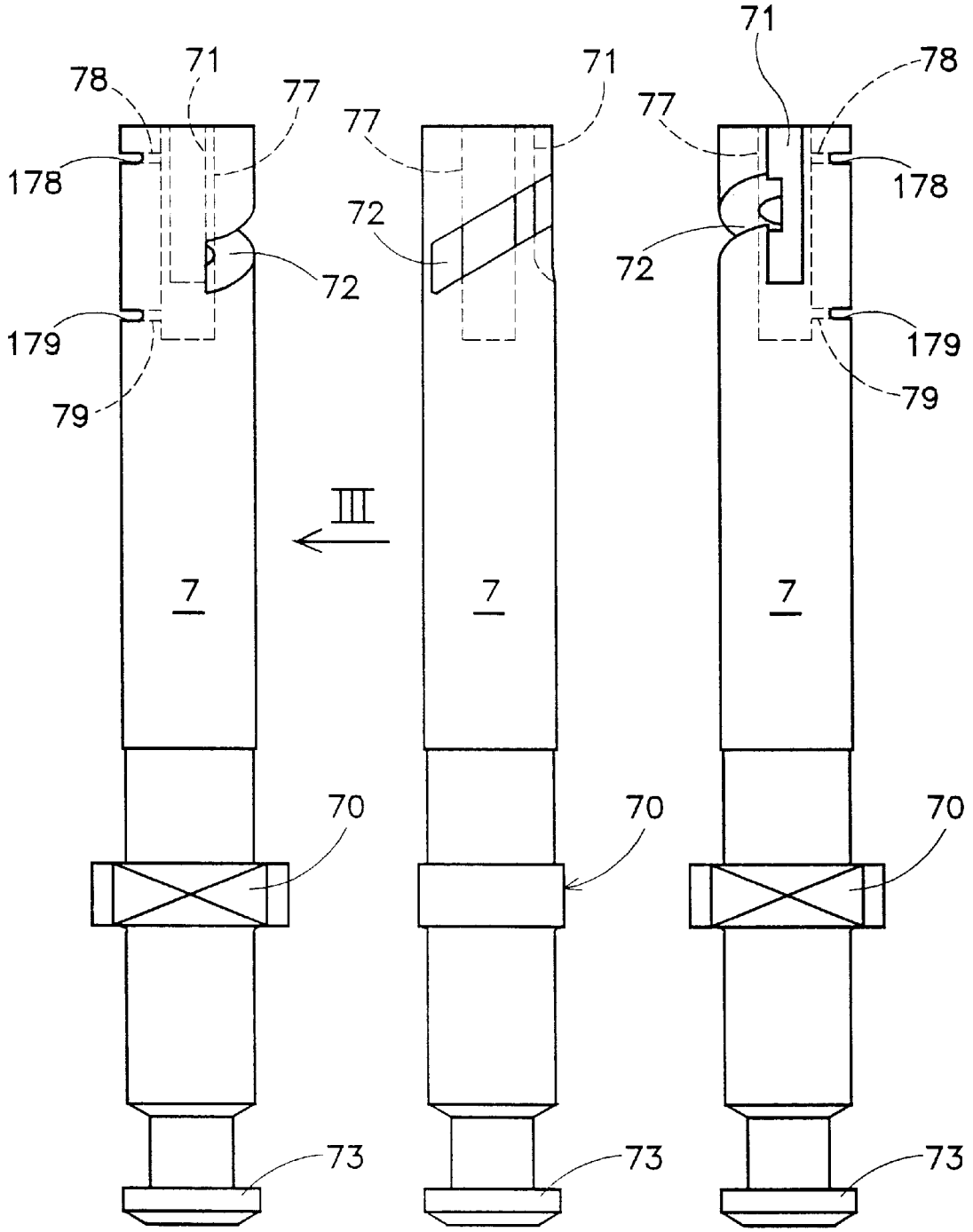
FIG. 2 is a front view of the pumping piston of the pump shown in FIG. 1.
FIG. 3 shows the same rotated through 90° in the direction of the arrow III and partly sectioned.
FIG. 4 shows the same rotated through a further 90°.

The bush 5 comprises a through radial hole 51 opening into the widened part 3 of the cavity 2, which assumes a toroidal configuration because of the presence of the bush. The pumping piston 7 (see FIGS. 2, 3 and 4) has an upper cylindrical portion comprising an axial groove 71 opening into the head or roof of the piston, and a helical groove 72 opening into said axial groove, as shown in the figures, and extending through at least 180° from the groove 71.

At its lower end the piston (FIG. 1) has a flat base 73, interacting with a chamber 12 which together with the return spring 13 is responsible for the reciprocating movement of the piston.

Within its intermediate portion the piston, by means of two flattened surfaces, is torsionally locked, but axially slidable, within a sleeve 75 which, by means of a pin 76, can rotate about its axis together with the piston, to modify the position of the grooves 71 and 72 relative to the hole 51.

Figures 5, 6, 7:
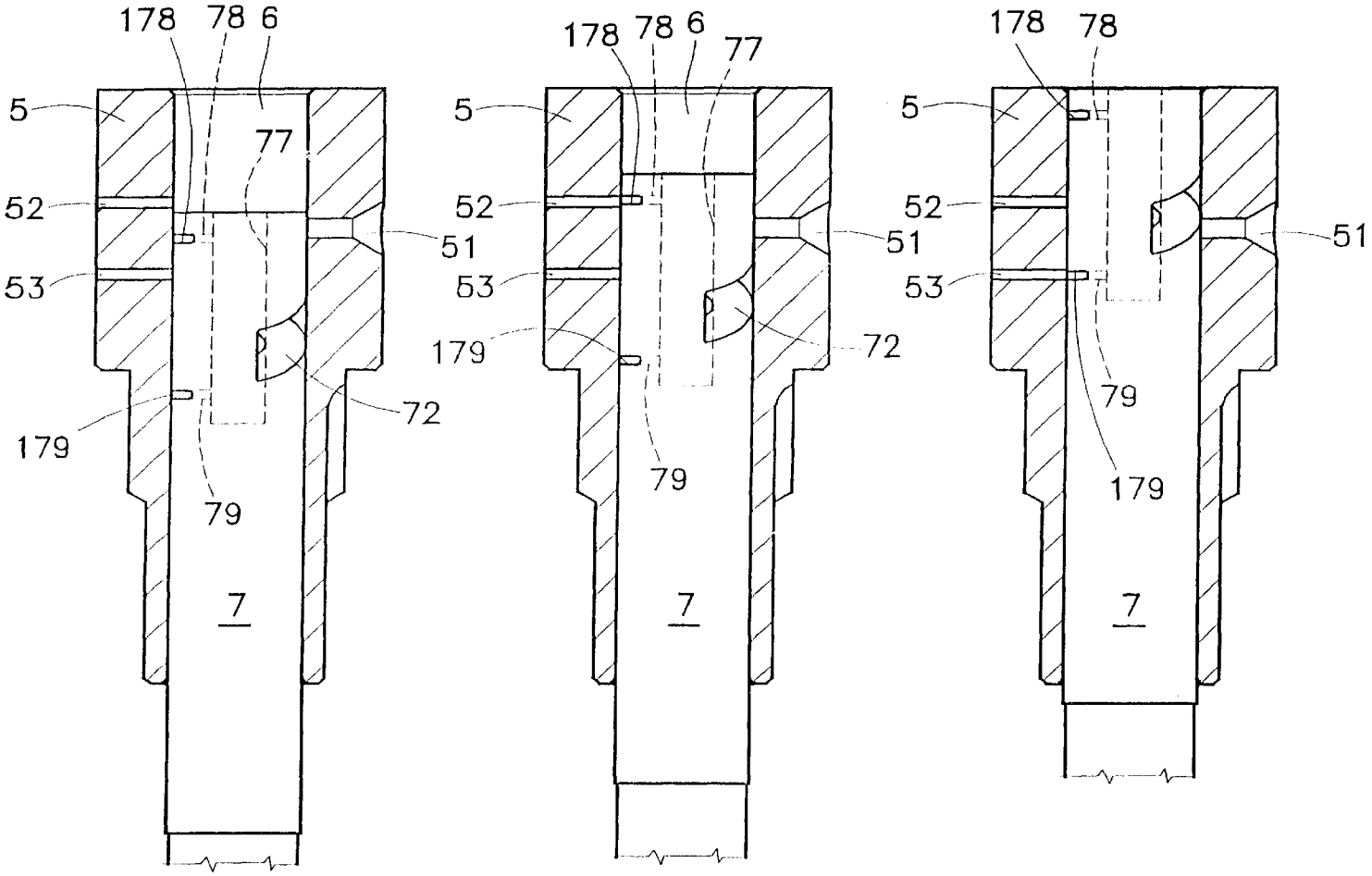
FIGS. 5, 6 and 7 show the various stages of the piston stroke in the pump of FIG. 1.

By virtue of the helical groove 72, the delivery stroke of the piston is divided into the following stages:

- a first fuel inflow stage A, when the piston is between its bottom dead centre and the point in which it closes the radial hole 51 (FIG. 5);
- a second stage, extending from this point to the point in which the hole 51 is opened by the helical groove 72, this being the actual delivery stage (FIG. 6);
- a third stage C, extending from this point to the top dead centre (FIG. 7).

During the second stage B the delivery valve opens with slight delay, and the fuel is injected in atomized form into the combustion chamber.

Combustion occurs suddenly, on termination of the ignition delay stage, and causes instantaneous pressure increase which is responsible both for the characteristic noise, or rhythmic beat, the residual pressure in the fuel intake conduits being responsible for the incomplete combustion and hence for the exhaust smoke.

To reduce these phenomena, according to the invention the roof of the pumping piston is connected to its lateral jacket by an axial hole 77 and two small radial holes 78 and 79, the first being of the order of a few tenths of a millimeter and the second of the order of one millimeter, these opening into two channels 178 and 179 of the same order of magnitude, which are provided in the lateral jacket at different heights.

In the illustrated example, the channels 178 and 179 are located in that region of the piston cylindrical jacket opposite the groove 72.

The channel 178 is intended, during the second stage B of the delivery stroke of the piston, whatever the angular orientation of this latter, to pass in front of a corresponding through hole 52 in the bush 5, which opens into the widened part 3 of the cavity 2.

It is apparent that the relative position of the channel 178 to the groove 72 in the piston jacket does not influence the invention, provided that the length of the channel is such that it always passes in front of the hole 52, whatever the angular orientation of the piston.

Because of this the fuel feed into the combustion chamber, which as seen occurs during the second stage of the delivery stroke of the pumping piston, is interrupted for an infinitesimal time, with simultaneous suppression of the pressure gradient, when the channel 178 passes in front of the hole 52.

In this manner the small quantity of fuel injected prior to the interruption ignites, to facilitate the subsequent ignition of the residual greater quantity injected after the interruption, with a reduced pressure gradient.

On termination of the delivery stroke of the piston, whatever the angular orientation of this latter, the channel 179 lies in front of a corresponding through hole 53 in the bush 5, which opens into the widened part 3 of the cavity 2.

It is apparent that the relative position of the channel 179 to the groove 72 in the piston jacket does not influence the invention, provided that the length of the channel is such that it is always located in front of the hole 53 on termination of the stroke of the piston, whatever the angular orientation of this latter.

Because of this the fuel located in the conduits on termination of the pumping stroke of the piston is suddenly discharged, so preventing feed prolongation due to the elasticity of the fuel.

As a result, there is both a considerable noise reduction and, in particular, elimination of undesired exhaust smoke.

We claim:

1. An injection pump for diesel-cycle internal combustion engines, comprising a casing (1), a cylinder (6) within said casing and communicating, via at least one radial aperture (51), with a fuel intake chamber (3), and a piston (7) sealedly slidable within said cylinder and which, by external command, can also rotate about its axis to assume different angular orientations about a reference plane, and comprises in its jacket a helical groove (72) opening into an axial groove (71), characterised in that the top, or roof, of said piston (7) is connected via a hole (77) to two channels (178, 179) provided at different levels in the piston jacket, the first (178) in an intermediate position between the top of the piston and highest part of said groove (72) to face during the reciprocating movement of the piston (7) a first radial aperture (52) provided in the cylinder and communicating with the fuel intake chamber (3), the second (179) at a distance from the top of the piston such that, when in the top dead centre position, it mates with a radial aperture (53) provided in the cylinder and communicating with the fuel intake chamber (3).

2. An injection pump as claimed in claim 1, characterised in that said hole (77) has a diameter not less than 1 mm.

* * * * *